US011130556B2

(12) United States Patent
Okamoto

(10) Patent No.: US 11,130,556 B2
(45) Date of Patent: Sep. 28, 2021

(54) WATERCRAFT AND EXHAUST STRUCTURE OF THE WATERCRAFT

(71) Applicant: YAMAHA HATSUDOKI KABUSHIKI KAISHA, Iwata (JP)

(72) Inventor: Haruo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/864,193

(22) Filed: May 1, 2020

(65) Prior Publication Data

US 2020/0255111 A1 Aug. 13, 2020

Related U.S. Application Data

(63) Continuation-in-part of application No. 15/461,515, filed on Mar. 17, 2017, now abandoned.

(30) Foreign Application Priority Data

Jul. 29, 2016 (JP) ..... JP2016-150144

(51) Int. Cl.
*B63H 21/32* (2006.01)
*B63H 21/38* (2006.01)
(Continued)

(52) U.S. Cl.
CPC ..... *B63H 21/32* (2013.01); *B63H 21/383* (2013.01); *F01N 13/004* (2013.01);
(Continued)

(58) Field of Classification Search
CPC ..... B63H 21/32; B63H 21/383; B63B 34/10; F01N 13/004; F01N 13/082; F01N 2240/20; F01N 2590/022
See application file for complete search history.

(56) References Cited

U.S. PATENT DOCUMENTS 5,554,058 A * 9/1996 LeQuire ..... F01N 13/004 440/89 R
5,934,959 A * 8/1999 Inman, Sr. ..... F01N 1/10 440/89 R
(Continued)

OTHER PUBLICATIONS

Vetus Exhaust Systems, archived as early as Sep. 27, 2008, ABC Powermarine (Year: 2008).*
(Continued)

*Primary Examiner* — Audrey B. Walter
(74) *Attorney, Agent, or Firm* — Keating & Bennett, LLP

(57) ABSTRACT

An exhaust system for a watercraft with an engine includes an upstream exhaust pipe including an end portion with an outlet, a water lock including an inner space accommodating the end portion, a downstream exhaust pipe connected to the water lock, and a flow direction diverter, such as a baffle. The upstream exhaust pipe guides exhaust gas from the engine to the end portion. The inner space of the water lock receives the exhaust gas from the outlet of the end portion. The downstream exhaust pipe exhausts the exhaust gas from the inner space to an outside of the watercraft body. The flow direction diverter changes a flow direction of the exhaust gas at the outlet to a cross direction which intersects a pipe axis of the end portion.

14 Claims, 6 Drawing Sheets

(51) Int. Cl.
*F01N 13/00* (2010.01)
*F01N 13/08* (2010.01)

(52) U.S. Cl.
CPC ..... *F01N 13/082* (2013.01); *F01N 2240/20* (2013.01); *F01N 2590/022* (2013.01)

(56) References Cited

U.S. PATENT DOCUMENTS

| | | | | |
|---|---|---|---|---|
| 6,206,741 | B1 * | 3/2001 | Matsuda | B63H 21/32<br>440/89 R |
| 6,213,827 | B1 * | 4/2001 | Hattori | F02B 61/045<br>440/89 R |
| 2008/0141666 | A1 * | 6/2008 | Mashiko | F01N 13/12<br>60/321 |
| 2018/0029683 | A1 * | 2/2018 | Okamoto | B63H 21/32 |

OTHER PUBLICATIONS

Okamoto, "Watercraft and Exhaust Structure of the Watercraft", U.S. Appl. No. 15/461,515, filed Mar. 17, 2017.

* cited by examiner

WATERCRAFT AND EXHAUST STRUCTURE OF THE WATERCRAFT

BACKGROUND OF THE INVENTION

1. Field of the Invention

The present invention relates to a watercraft including an engine, and an exhaust system for the watercraft.

2. Description of the Related Art

A water vehicle disclosed in Japanese Patent Application Publication No. 2008-157217 includes an exhaust device that exhausts gas emitted from an engine to the outside of a watercraft body. The exhaust device includes a first exhaust pipe extending rearward from a side portion of the engine, a water lock having a tank shape connected to a rear end portion of the first exhaust pipe, and a second exhaust pipe which is connected to a rear portion of the water lock and which opens at a lower portion of a rear end of the watercraft body. The interior of the water lock is divided into an upstream area and a downstream area by a partition. A partition pipe penetrates the partition. The rear end portion of the first exhaust pipe includes an inner pipe located at the upstream area in the water lock. An upstream end portion of the second exhaust pipe is located at the downstream area in the water lock.

The exhaust gas emitted from the engine flows from an outlet of the inner pipe into the upstream area in the water lock via the first exhaust pipe, passes the partition pipe, and flows into the downstream area in the water lock. The exhaust gas is then exhausted to the outside of the watercraft body via the second exhaust pipe.

The outlet of the inner pipe disclosed in Japanese Patent Application Publication No. 2008-157217 is opposed to or faces the partition in a direction along a pipe axis of the inner pipe. Thus, a portion of the exhaust gas flowing into the upstream area in the water lock from the outlet flows straight along the pipe axis and collides with the partition and the partition pipe. Accordingly, there is a possibility that turbulence occurs in the water lock. If turbulence occurs in the water lock, it is difficult for the exhaust gas in the water lock to reach the second exhaust pipe, and the exhaust efficiency to the outside of the watercraft body deteriorates.

SUMMARY OF THE INVENTION

In order to overcome the previously unrecognized and unsolved challenges described above, a preferred embodiment of the present invention provides a watercraft including a watercraft body, an engine in the watercraft body, an upstream exhaust pipe including an end portion including an outlet, a water lock including an inner space which houses the end portion, a downstream exhaust pipe connected to the water lock, and a flow direction diverter. The upstream exhaust pipe, the water lock, the downstream exhaust pipe, and the flow direction diverter define an exhaust system of the watercraft. The upstream exhaust pipe guides the exhaust gas from the engine to the end portion. The inner space of the water lock receives the exhaust gas from the outlet of the end portion. The downstream exhaust pipe exhausts the exhaust gas from the inner space to an outside of the watercraft body. The flow direction diverter changes a flow direction of the exhaust gas at the outlet to a cross direction which intersects a pipe axis of the end portion.

According to this preferred embodiment, the exhaust gas that reaches the end portion of the upstream exhaust pipe from the engine flows into the inner space of the water lock from the outlet of the end portion to the cross direction intersecting the pipe axis of the end portion. The exhaust gas which flows into the inner space of the water lock flows along an inner wall of the water lock. Thus, turbulence in the water lock is significantly reduced or prevented, the exhaust gas in the water lock smoothly reaches the downstream exhaust pipe, and the exhaust gas is exhausted to the outside of the watercraft body. Accordingly, exhaust efficiency is improved.

In a preferred embodiment of the present invention, the end portion penetrates an inner wall of the water lock along a pipe axis direction, and the flow direction diverter changes the flow direction of the exhaust gas to a direction along the inner wall.

According to this preferred embodiment, the exhaust gas which flows into the inner space of the water lock from the outlet of the end portion of the upstream exhaust pipe flows along the inner wall of the water lock. Flow of the exhaust gas in the inner space of the water lock is accelerated. Thus, turbulence in the water lock is further reduced or prevented, and exhaust efficiency is further improved.

In a preferred embodiment of the present invention, the outlet preferably opens radially to the outside of the upstream exhaust pipe at the end portion. According to this preferred embodiment, the exhaust gas flows along the inner wall of the water lock. Flow of the exhaust gas in the inner space of the water lock is accelerated. Thus, turbulence in the water lock is further reduced or prevented, and exhaust efficiency is further improved.

In a preferred embodiment of the present invention, the flow direction diverter includes a baffle that blocks the exhaust gas which reaches the end portion to change the flow direction of the exhaust gas.

According to this preferred embodiment, the exhaust gas which reaches the end portion of the upstream exhaust pipe cannot flow straight along the pipe axis of the end portion due to the baffle. Thus, the flow direction of the exhaust gas at the outlet of the end portion is changed to the cross direction.

In a preferred embodiment of the present invention, the watercraft further includes a fastener that fastens the baffle to the end portion.

According to this preferred embodiment, the baffle is stabilized by being fastened to the end portion of the upstream exhaust pipe, and blocks the exhaust gas which reaches the end portion to change the flow direction of the exhaust gas.

In a preferred embodiment of the present invention, the fastener includes three or more fasteners.

According to this preferred embodiment, the baffle is fastened to the end portion of the upstream exhaust pipe by the three or more fasteners. Thus, the baffle is further stabilized.

In a preferred embodiment of the present invention, the watercraft further includes a drain pipe surrounding the end portion. A flow passage is defined between the drain pipe and the end portion, and guides engine cooling water to the inner space.

According to this preferred embodiment, cooling water which flows into the inner space of the water lock from the flow passage smoothly reaches the downstream exhaust pipe and is drained to the outside of the watercraft body from the downstream exhaust pipe by being carried by the exhaust gas flowing along the inner wall of the water lock. Thus, both exhaust efficiency and cooling water drainage efficiency is improved, and turbulence in the water lock is significantly reduced or prevented, as discussed above. For example, spray of cooling water stirred by the turbulence in the water lock is significantly reduced or prevented. Thus, spray flowing backward in the upstream exhaust pipe by infiltrating into the upstream exhaust pipe from the outlet is significantly reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described in detail with reference to the accompanying drawings.

First Preferred Embodiment

Figure 1:
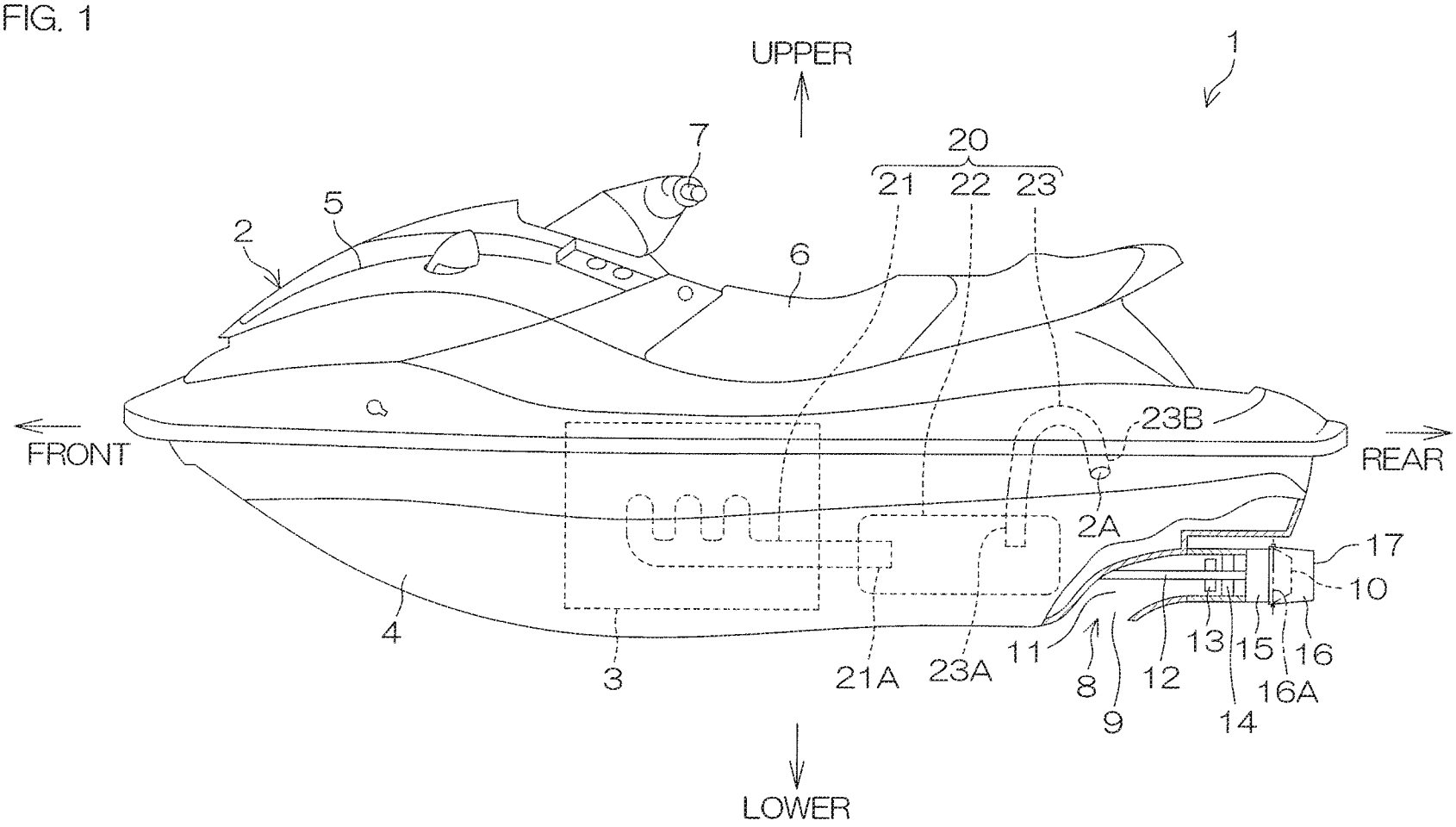
FIG. 1 is a schematic view of a watercraft according to a preferred embodiment of the present invention.

FIG. 1 is a schematic view of a watercraft 1 according to a preferred embodiment of the present invention. A right-left direction in FIG. 1 is defined as the front-rear direction of the watercraft 1. The left side in FIG. 1 shows the front of the watercraft 1. A right-left direction of the watercraft 1 is seen when facing in the traveling direction of the watercraft 1. Thus, the near side in a direction perpendicular to the sheet of FIG. 1 corresponds to the left of the watercraft 1, and the far side in the direction perpendicular to the sheet of FIG. 1 corresponds to the right of the watercraft 1.

The watercraft 1 includes a watercraft body 2, and an engine 3 in an interior of the watercraft body 2. The watercraft body 2 includes a hull 4 that defines a watercraft bottom, and a deck 5 located above the hull 4. The watercraft body 2 is elongated in the front-rear direction. The engine 3 is located in an engine room between the hull 4 and the deck 5 in an up-down direction. The engine 3 is preferably an internal combustion engine including a crankshaft that rotates about a crank axis extending in the front-rear direction.

The watercraft 1 of this preferred embodiment is preferably a jet propelled watercraft, for example, and further includes a seat 6 on which a rider sits, a steering handle 7 that is operated to the right and left by the rider, and a jet pump 8 mounted on a rear portion of the watercraft body 2. The seat 6 and the steering handle 7 are located on an upper side of the watercraft body 2. A throttle lever is mounted on a right end portion of the steering handle 7. A driving force of the engine 3 is adjusted by operation of the throttle lever by the rider.

The jet pump 8 is located rearward relative to the engine 3. The jet pump 8 sucks in water from the watercraft bottom and ejects the water to an outside of the watercraft body 2 by a driving force of the engine 3. The jet pump 8 generates a thrust to propel the watercraft 1 forward.

For example, the jet pump 8 includes an intake 9 into which water outside the watercraft body 2 is sucked, an outlet 10 from which the water sucked in from the intake 9 is ejected rearward, and a flow passage 11 that guides the water sucked into the intake 9 to the outlet 10. The jet pump 8 further includes a driveshaft 12 extending in the front-rear direction, an impeller 13 and a stator vane 14 that are located in the flow passage 11, a nozzle 15, and a deflector 16 that deflects or directs water ejected rearward from the nozzle 15 to the right and left.

The intake 9 opens at the watercraft bottom, and the outlet 10 opens rearward at a location farther to the rear than the intake 9. A front end portion of the driveshaft 12 is located in the watercraft body 2 and coupled to the crankshaft of the engine 3 via a coupling or the like, for example. A rear end portion of the driveshaft 12 is located in the flow passage 11 and coupled to the impeller 13. The stator vane 14 is located behind the impeller 13, and the nozzle 15 is located behind the stator vane 14. The stator vane 14 and the nozzle 15 are fixed with respect to the flow passage 11.

The impeller 13 is rotatable in the flow passage 11 about a central axis of the driveshaft 12. The impeller 13 is driven by the engine 3 to rotate about the central axis of the driveshaft 12 together with the driveshaft 12. When the impeller 13 is driven to rotate, water outside the watercraft body 2 is sucked into the flow passage 11 from the intake 9 and is fed from the impeller 13 to the stator vane 14. A torsional water flow produced by rotation of the impeller 13 is reduced and straightened by the water fed by the impeller 13 and passing through the stator vane 14. Thus, the flow-straightened water is delivered from the stator vane 14 to the nozzle 15. The nozzle 15 preferably has a tubular or substantially tubular shape extending in the front-rear direction, and the outlet 10 is defined by a rear end portion of the nozzle 15. The water fed to the nozzle 15 is thus jetted rearward from the outlet 10 of the rear end portion of the nozzle 15.

The deflector 16 extends rearward from the nozzle 15. The deflector 16 is coupled to the nozzle 15 and rotates to the right and left about a deflector axis 16A extending in the up-down direction. The deflector 16 is preferably hollow. The outlet 10 of the nozzle 15 is located in the deflector 16. The deflector 16 defines an ejection port 17 that opens rearward. The ejection port 17 is located behind the outlet 10. Water jetted rearward from the outlet 10 penetrates through an interior of the deflector 16 and is ejected rearward from the ejection port 17. The deflector 16 turns to the right and left according to an operation of the steering handle 7. The water that is ejected from the jet pump 8 is directed to the right and left by the operation of the steering handle 7 to steer the watercraft 1.

The watercraft 1 further includes an exhaust system 20 that exhausts exhaust gas generated in the engine 3 to the outside of the watercraft body 2. An exhaust port 2A is located at a rear of a left surface or a right surface of the watercraft body 2. The exhaust system 20 includes an upstream exhaust pipe 21, a water lock 22, and a downstream exhaust pipe 23. The exhaust system 20 is located in the watercraft body 2.

The upstream exhaust pipe 21 is connected to an exhaust port of a cylinder of the engine 3. When there are two or more cylinders, the exhaust port of each cylinder is connected to the upstream exhaust pipe 21 which joins each exhaust port and then extends rearward. The upstream exhaust pipe 21 guides the exhaust gas from the exhaust port of the engine 3 rearward. An end portion 21A, which is located at a downstream end of the upstream exhaust pipe 21 in a flow direction of the exhaust gas, defines a rear end portion of the upstream exhaust pipe 21. In a preferred embodiment, at least the upstream exhaust pipe 21 of the exhaust system 20 is made of metal since the exhaust gas emitted from the engine 3 and flowing into the upstream exhaust pipe 21 is relatively hot.

Figure 2:
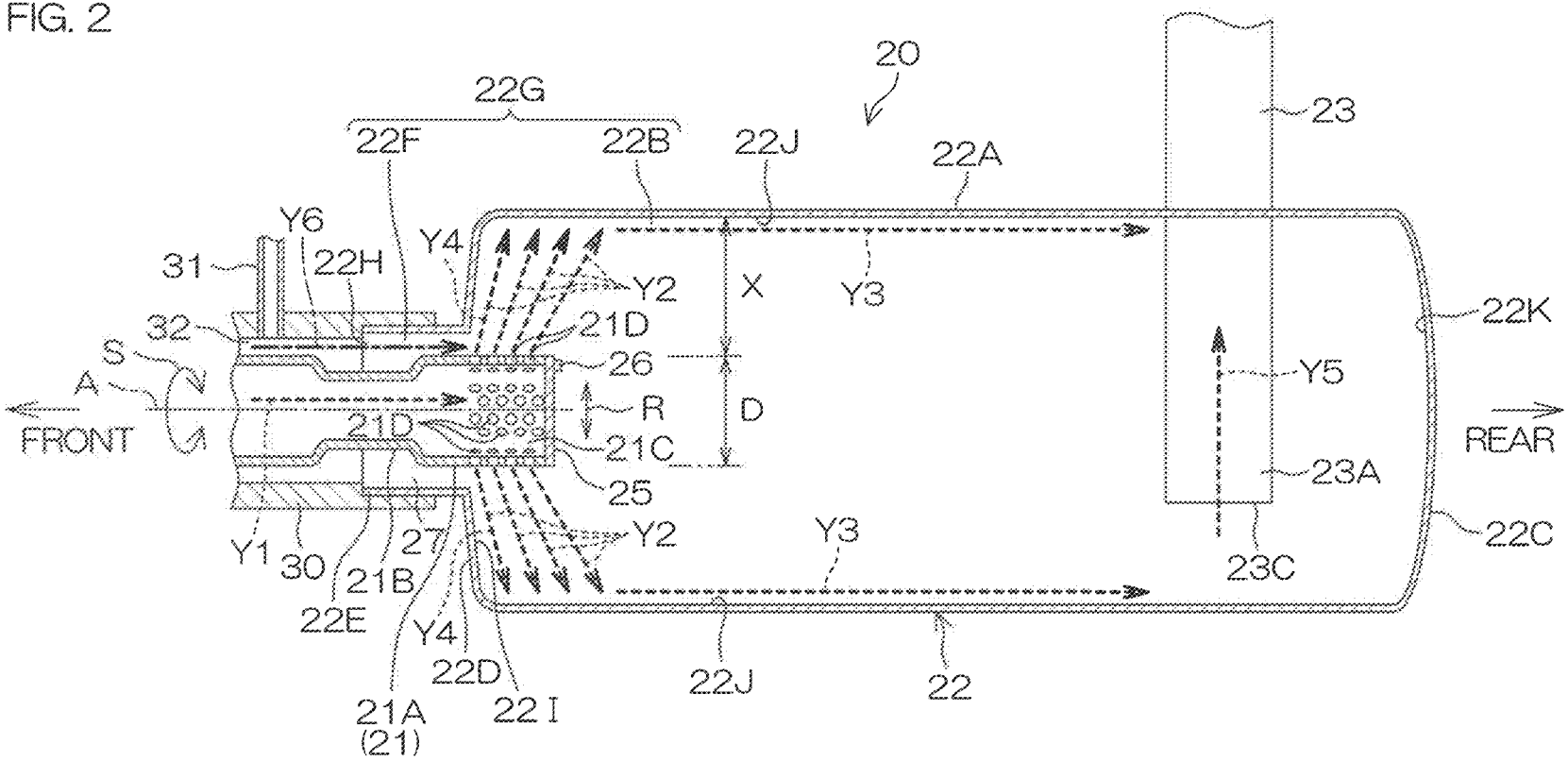
FIG. 2 is a sectional view of an exhaust system of the watercraft cut along a plane extending in the up-down and front-rear directions.

FIG. 2 is a sectional view of the exhaust system 20 when cut along a plane extending in the up-down and front-rear directions and seen from left. The end portion 21A preferably has a pipe shape (for example, a circular or substantially circular pipe shape) including a pipe axis A. In a preferred embodiment, a pipe axis direction of the pipe axis A coincides with the front-rear direction of the watercraft 1. In another preferred embodiment, the end portion 21A has, for example, a rectangular or substantially rectangular pipe shape having a polygonal cross section, such as a rectangular or substantially rectangular shape, when cut along a plane perpendicular to the pipe axis A. A narrow portion 21B in the middle of the end portion 21A in the front-rear direction is one step narrower than the end portion 21A. A circular or substantially circular opening 21C is located at a rear end of the end portion 21A. A plurality of outlets 21D are disposed on an outer peripheral surface of the end portion 21A. Each of the outlets 21D penetrates the end portion 21A along a radial direction R, with the pipe axis A as a center, and opens to the outside in the radial direction R. In a preferred embodiment, the outlets 21D include, for example, four or more outlets 21D aligned in the front-rear direction at equal or substantially equal intervals that define a line. In a preferred embodiment, a plurality of lines are aligned in a circumferential direction S about the pipe axis A on the outer peripheral surface of the end portion 21A. A plurality of lines are distributed in a circumferential direction S about the pipe axis A on the outer peripheral surface of the end portion 21A and are located rearward relative to the narrow portion 21B. In a preferred embodiment, the outlet 21D includes, for example, a round or substantially round hole or a slit extending in the front-rear direction or the circumferential direction S. The outlet 21D may include one or more than one outlet 21D.

The exhaust system 20 further includes a baffle 25 serving as a flow direction diverter. In a preferred embodiment, the baffle 25 preferably has a circular or substantially circular plate shape, for example, with a plate thickness direction that coincides with the front-rear direction. The baffle 25 is opposed to or covers the end portion 21A from the rear and blocks the opening 21C. The end portion 21A includes the baffle 25 when the baffle 25 is fastened to the end portion 21A such that the exhaust gas is not emitted from the end portion 21A along the pipe axis A. In a preferred embodiment, the baffle 25 is fastened to the end portion 21A by a plurality of bolts 26, for example, that serve as fasteners. In a preferred embodiment, three bolts 26, for example, define and function as the fasteners.

Figure 3:
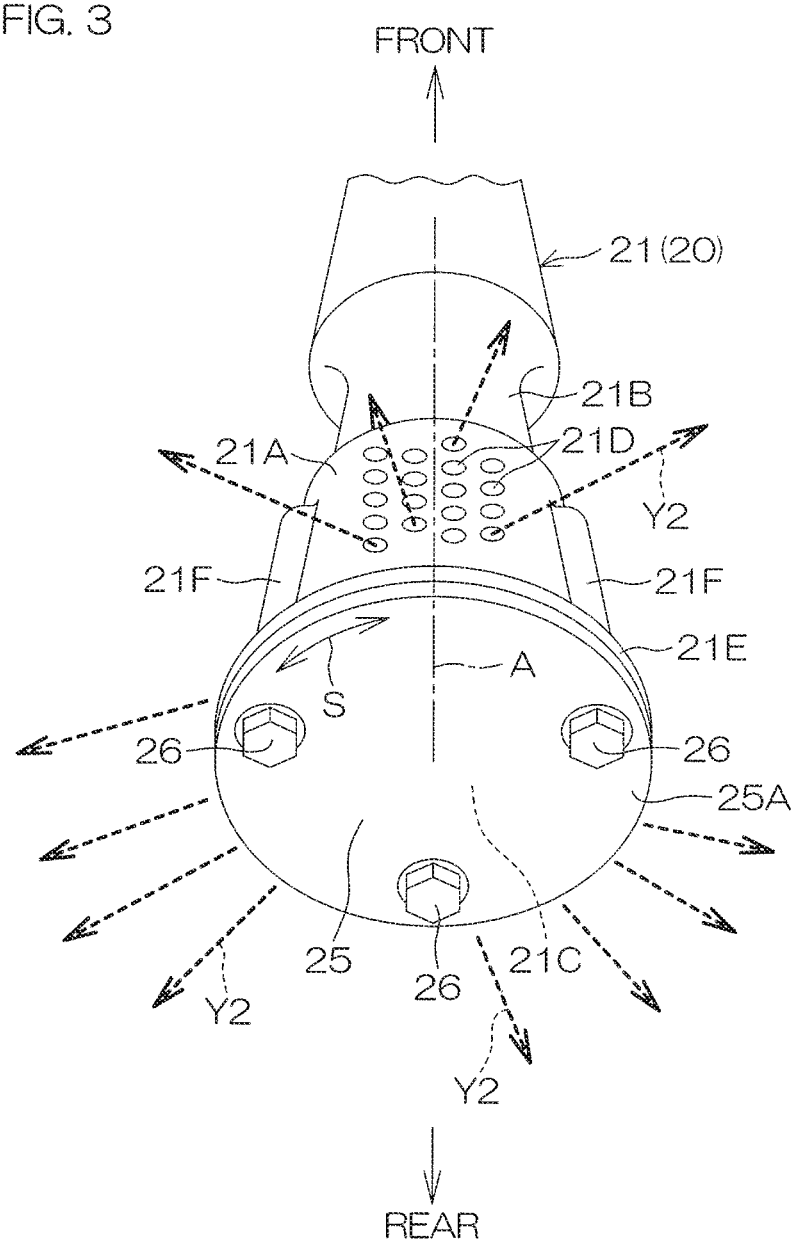
FIG. 3 is a perspective view of an end portion of an upstream exhaust pipe of the exhaust system.

FIG. 3 is a perspective view of the end portion 21A to which the baffle 25 is fastened as seen from the rear. The end portion 21A integrally and unitarily includes a ring-shaped or substantially ring-shaped flange 21E which overhangs to the outside in the radial direction R from all areas in the circumferential direction S of a rear end of the end portion 21A, and a bulge 21F which bulges to the outside in the radial direction R from the outer peripheral surface of the end portion 21A and which extends forward from the flange 21E. In a preferred embodiment, the bulge 21F includes two or more bulges 21F corresponding to a number of the bolts 26. For example, in a preferred embodiment, three bulges 21F are aligned in the circumferential direction S at equal or substantially equal intervals. The outlets 21D are deviated or offset from the bulge 21F in the circumferential direction S. For example, the outlets 21D are disposed between neighboring bulges 21F. An outer periphery 25A of the baffle 25 overlaps with the flange 21E from the rear.

A screw portion or thread of each bolt 26 penetrates the outer periphery 25A and the flange 21E from the rear and is installed in a screw hole in the corresponding bulge 21F. The three bolts 26 are aligned in the circumferential direction S at equal or substantially equal intervals. Thus, the baffle 25 is fastened to the end portion 21A by the three bolts 26. In this preferred embodiment, the baffle 25 is more stable than when two or less bolts 26 are used.

The water lock 22 is located between the engine 3 and the jet pump 8 in the front-rear direction (FIG. 1). Referring to FIG. 2, the water lock 22 preferably has an elongated tank shape, for example, that extends in the front-rear direction. The water lock 22 integrally and unitarily includes a cylindrical or substantially cylindrical portion 22A (hereinafter, "cylindrical portion 22A") which extends in the front-rear direction, a rear baffle 22C which is connected to a rear end of the cylindrical portion 22A and blocks an inner space 22B of the cylindrical portion 22A from the rear, and a front baffle 22D which is connected to a front end portion of the cylindrical portion 22A and blocks the inner space 22B from the front. Each of the rear baffle 22C and the front baffle 22D preferably has a circular or substantially circular plate shape. In a preferred embodiment, the rear baffle 22C is curved and bulges rearward, and the front baffle 22D is curved and bulges forward. A protruding portion 22E protruding forward is integrally and unitarily disposed at a central or substantially central portion of the front baffle 22D. The protruding portion 22E preferably has a cylindrical or substantially cylindrical shape having a smaller outer diameter than that of the cylindrical portion 22A. An inner space 22F of the protruding portion 22E communicates with the inner space 22B of the cylindrical portion 22A from the front. An entire inner space 22G of the water lock 22 includes the inner space 22F and the inner space 22B. An opening 22H communicating with the inner space 22F is disposed at a front end of the protruding portion 22E.

A portion of the end portion 21A of the upstream exhaust pipe 21 that is located rearward relative to at least the narrow portion 21B is inserted into the inner space 22F of the protruding portion 22E from the opening 22H. The end portion 21A is inserted beyond the protruding portion 22E to a front end portion of the inner space 22B of the cylindrical portion 22A. For example, the end portion 21A penetrates an inner wall 221 of the water lock 22 of the front baffle 22D along the front-rear direction. At least the outlet 21D of the end portion 21A is located in the inner space 22B of the cylindrical portion 22A. The end portion 21A within the inner space 22B is preferably coaxial with the cylindrical portion 22A and the protruding portion 22E. In a preferred embodiment, the pipe axis A is preferably parallel or substantially parallel to a central axis of the cylindrical portion 22A. A flow passage 27 is defined between the end portion 21A and the protruding portion 22E which surrounds the end portion 21A. The flow passage 27 is preferably ring-shaped, extends in the front-rear direction between the end portion 21A and the protruding portion 22E, and communicates with the inner space 22B from the front.

The downstream exhaust pipe 23 includes an upstream end portion 23A connected to the water lock 22 by penetrating the cylindrical portion 22A of the water lock 22 from above, and a downstream end portion 23B (FIG. 1) connected to the exhaust port 2A of the watercraft body 2. The downstream exhaust pipe 23 extends from the upstream end portion 23A to the downstream end portion 23B. In order to prevent water from outside the watercraft body 2, such as seawater, from flowing backward in the downstream exhaust pipe 23, a midway portion of the downstream exhaust pipe 23 between the upstream end portion 23A and the downstream end portion 23B is bent to extend upward and then downward (FIG. 1).

The upstream end portion 23A is located at a rear portion of the inner space 22B of the cylindrical portion 22A. An inlet 23C which opens downward is located at a lower end of the upstream end portion 23A. When the watercraft 1 is upset or overturned and the up-down direction of the watercraft body 2 and the exhaust system 20 is reversed, the inlet 23C is located at a higher position than the water surface around the watercraft body 2. Thus, water outside the watercraft body 2 that may flow backward in the downstream exhaust pipe 23 from the exhaust port 2A and infiltrate into the water lock 22 from the inlet 23C is significantly reduced or prevented. The upstream end portion 23A is preferably at a same or a substantially same position as the end portion 21A of the upstream exhaust pipe 21 and the baffle 25 in the right-left direction of the watercraft 1 (a direction perpendicular to the sheet of FIG. 2) and is opposed to or overlaps the end portion 21A and the baffle 25 from the rear in the inner space 22B. Alternatively, the upstream end portion 23A may be located at a position deviated from the end portion 21A and the baffle 25 in the right-left direction.

The exhaust system 20 further includes a drain pipe 30 and a cooling pipe 31. The drain pipe 30 preferably coaxially surrounds the end portion 21A of the upstream exhaust pipe 21 and defines a flow passage 32 between the drain pipe 30 and the end portion 21A. The flow passage 32 is preferably ring-shaped and extends in the front-rear direction between an outer circumferential surface of the end portion 21A and an inner circumferential surface of the drain pipe 30. A front end portion of the flow passage 32 is closed. The flow passage 32 communicates with the flow passage 27, which is between the end portion 21A and the protruding portion 22E of the water lock 22, from the front via the opening 22H of the protruding portion 22E.

The cooling pipe 31 is connected to the engine 3 and the drain pipe 30. The watercraft body 2 includes a cooling passage which takes in water from outside the watercraft body 2 and from the watercraft bottom as cooling water and feeds the water to the engine 3. Cooling water, which passes through the cooling passage and cools the engine 3, flows into the flow passage 32 via the cooling pipe 31, passes the flow passage 32 and the flow passage 27, and then flows into the inner space 22B of the cylindrical portion 22A of the water lock 22. Thus, the flow passage 32 and the flow passage 27 guide the cooling water for the engine 3 from the cooling pipe 31 to the inner space 22B. At a joint between the drain pipe 30 and the protruding portion 22E, a rear end portion of the drain pipe 30 is securely connected to an outside surface of the protruding portion 22E in the radial direction R. Thus, leakage of cooling water from the joint between the drain pipe 30 and the protruding portion 22E is significantly reduced or prevented.

The exhaust gas from the engine 3 flows in the upstream exhaust pipe 21 and is guided to the end portion 21A. The exhaust gas which reaches the end portion 21A flows rearward along the pipe axis A in the end portion 21A, as shown by a broken line arrow Y1.

The baffle 25 is located beyond the exhaust gas which flows rearward in the end portion 21A. For example, the exhaust gas in the end portion 21A is blocked by the baffle 25. The baffle 25 which is fastened to the end portion 21A by the bolts 26 blocks the exhaust gas which reaches the end portion 21A.

The exhaust gas in the end portion 21A cannot flow straight along the pipe axis A because the exhaust gas is blocked by the baffle 25. Thus, the exhaust gas changes flow direction to a cross direction Y2, which intersects the pipe axis A, and passes the outlets 21D of the end portion 21A. The outlets 21D open in a direction that is perpendicular or substantially perpendicular to the pipe axis A. The flow direction of the exhaust gas is changed by being emitted from the outlets 21D. More specifically, the baffle 25 changes the flow direction of the exhaust gas in the end portion 21A to the cross direction Y2 at the outlets 21D by blocking the exhaust gas in the end portion 21A. Thus, the exhaust gas in the end portion 21A flows into the inner space 22B of the cylindrical portion 22A of the water lock 22 by being diffused radially outward in the cross direction Y2 from the outlets 21D (FIG. 3).

The cross direction Y2 may be inclined rearward with respect to the pipe axis A. In a preferred embodiment, a portion of an inner wall of the water lock 22 that is parallel or substantially parallel with the pipe axis A, for example, an inner wall 22J of the cylindrical portion 22A, is located beyond the exhaust gas which flows into the inner space 22B from the outlets 21D. The outlets 21D open toward the inner wall 22J of the cylindrical portion 22A. Thus, the exhaust gas which flows into the water lock 22 flows rearward along the inner wall 22J, as shown by a broken line arrow Y3.

In a preferred embodiment, a distance X between the inner wall 22J of the cylindrical portion 22A of the water lock 22 and the flow direction diverter, i.e., the baffle 25, in a direction perpendicular to the pipe axis A is preferably not less than about 10 mm and not more than about 400 mm, for example. In a preferred embodiment, the distance X between the inner wall 22J of the cylindrical portion 22A of the water lock 22 and the flow direction diverter in the direction perpendicular to the pipe axis A is preferably not less than about 30 mm and not more than about 300 mm, for example. In a preferred embodiment, the distance X between the inner wall 22J and the baffle 25 in the direction perpendicular to the pipe axis A is not less than about one-half of an outer dimension D of the baffle 25 and not more than about ten times the outer dimension D, for example.

The cross direction Y2 is preferably not only inclined with respect to the pipe axis A but also extends along the inner wall 221 of the front baffle 22D which is perpendicular or substantially perpendicular to the pipe axis A, as shown by a broken line arrow Y4. In this preferred embodiment, the exhaust gas which flows into the inner space 22B flows to the outside in the radial direction R along the inner wall 221, as shown by the broken line arrow Y4, toward a circular arc portion joining the inner wall 221 to the inner wall 22J of the cylindrical portion 22A. Thus, the circular arc portion curves from the direction perpendicular to the pipe axis A toward a direction parallel to the pipe axis A. The exhaust gas then flows rearward along the inner wall 22J of the cylindrical portion 22A as shown by the broken line arrow Y3.

The exhaust gas flows rearward along the inner wall 22J of the cylindrical portion 22A. Thus, the occurrence of turbulence in the water lock 22 is significantly reduced or prevented. For example, the exhaust gas in the water lock 22 reaches the inlet 23C of the downstream exhaust pipe 23 without being affected by the turbulence, refer to a broken line arrow Y5. The exhaust gas in the water lock 22 reaches the inlet 23C after flowing rearward along the inner wall 22J and flowing along an inner wall 22K of the rear baffle 22C. Alternatively, the exhaust gas reaches the inlet 23C while flowing along the inner wall 22J. The exhaust gas which reaches the inlet 23C is exhausted to the outside of the watercraft body 2 from the exhaust port 2A (FIG. 1) after passing the downstream exhaust pipe 23.

When the exhaust gas flows along the inner wall 22J of the water lock 22, even if the exhaust gas is forceful due to high-speed rotation, acceleration, or deceleration of the engine 3, turbulence in the water lock 22 is significantly reduced or prevented and exhaust efficiency is improved.

Cooling water (shown by a dashed line arrow Y6) which flows into the inner space 22G of the water lock 22 from the flow passages 32 and 27 is carried by the exhaust gas, as shown by the broken line arrows Y2 and Y3, which is diffused in the cross direction Y2 from the outlets 21D and flows along the inner wall 22J of the water lock 22. For example, the cooling water reaches the downstream exhaust pipe 23, is mixed with the exhaust gas, and is drained to the outside of the watercraft body 2 from the downstream exhaust pipe 23. Thus, exhaust noise of the exhaust gas is significantly decreased or minimized compared to when only the exhaust gas is exhausted to the outside of the watercraft body 2.

Not only the exhaust gas, but also the cooling water flows along the inner wall 22J. Thus, not only exhaust gas exhaust efficiency but also cooling water drainage efficiency are both improved. Moreover, because the turbulence of the exhaust gas in the water lock 22 is significantly reduced or prevented, spray of the cooling water stirred by the turbulence in the water lock 22 is significantly reduced or prevented. Thus, spray reaching the engine 3 by flowing backward in the upstream exhaust pipe 21 after infiltrating into the upstream exhaust pipe 21 from the outlet 21D of the end portion 21A is significantly reduced or prevented. Since it is not necessary to account for a backward flow of the cooling water in the upstream exhaust pipe 21, a length of the upstream exhaust pipe 21 is reduced and a size of the exhaust system 20 and the entire watercraft 1 is thus reduced.

Although a first preferred embodiment of the present invention has been described above, the present invention is not restricted to the contents of the first preferred embodiment and various modifications are possible within the scope of the present invention.

Other Preferred Embodiments

Figure 4:
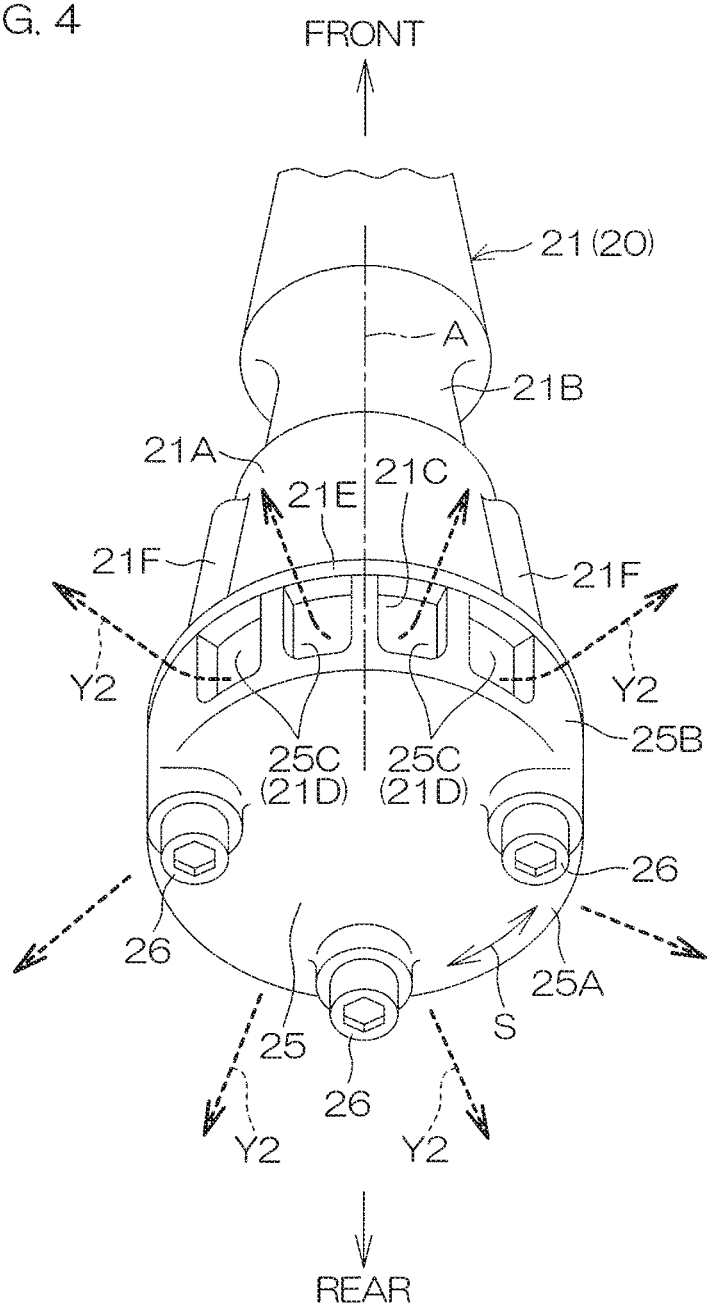
FIG. 4 is a perspective view of an end portion of an upstream exhaust pipe according to a first modification of a preferred embodiment of the present invention.
Figure 5:
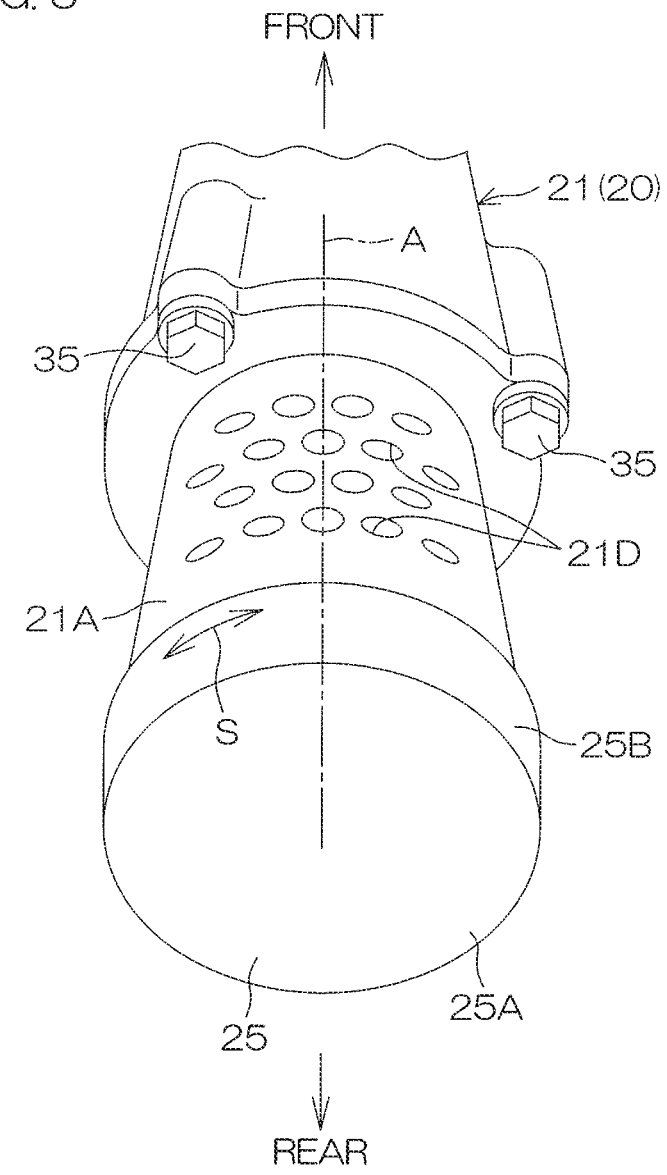
FIG. 5 is a perspective view of an end portion of an upstream exhaust pipe according to a second modification of a preferred embodiment of the present invention.
Figure 6:
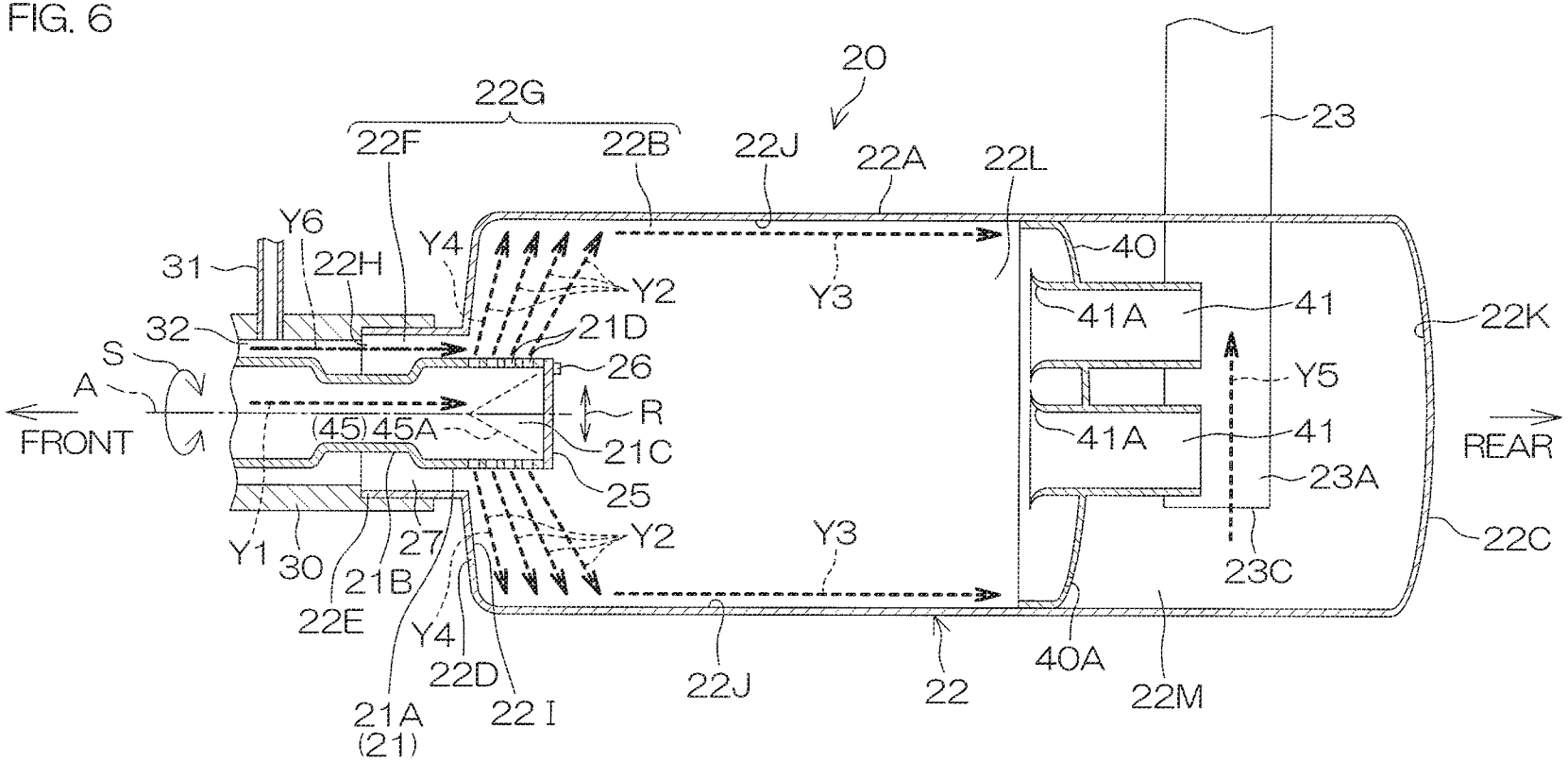
FIG. 6 is a sectional view of an exhaust system according to a third modification of a preferred embodiment of the present invention cut along a plane extending in the up-down and front-rear directions.

FIG. 4 is a perspective view of the end portion 21A of the upstream exhaust pipe 21 according to a first modification of a preferred embodiment of the present invention as seen from the rear. FIG. 5 is a perspective view of the end portion 21A of the upstream exhaust pipe 21 according to a second modification of a preferred embodiment of the present invention as seen from the rear. FIG. 6 is a sectional view of the exhaust system 20 according to a third modification of a preferred embodiment of the present invention. Elements that are the same as those described above are identified in FIGS. 4, 5 and 6 by the same reference numerals, and a description thereof will be omitted.

In the first modification shown in FIG. 4, the outlets 21D on the outer peripheral surface of the end portion 21A are omitted, and the baffle 25 integrally and unitarily includes a cylindrical or substantially cylindrical portion 25B (hereinafter, "cylindrical portion 25B") which extends forward from the outer periphery 25A. The cylindrical portion 25B contacts the flange 21E from the rear. Thus, the baffle 25 is opposed to or covers the opening 21C of the end portion 21A at intervals in the front-rear direction. For example, the opening 21C is not blocked by the baffle 25 and opens rearward. A plurality of notches 25C aligned in the circumferential direction S are disposed on the cylindrical portion 25B. Each notch 25C extends forward from a rear end of the cylindrical portion 25B and penetrates the cylindrical portion 25B in the radial direction R. Each notch 25C is blocked from the front by the flange 21E and defines and functions as the outlet 21D. Each notch 25C communicates with a gap, which is between the baffle 25 and the opening 21C in the front-rear direction, from the outside in the radial direction R.

In the first modification, the exhaust gas, which passes in the upstream exhaust pipe 21 and is guided to the end portion 21A, flows rearward along the pipe axis A and passes through the opening 21C. The baffle 25 is located downstream of the opening 21C. The exhaust gas is blocked by the baffle 25 and changes its flow direction to the cross direction Y2 which intersects the pipe axis A. The exhaust gas passes through each notch 25C and flows into the inner space 22B of the water lock 22 by being diffused outward in the radial direction R. The radially diffused exhaust gas flows rearward along the inner wall 22J of the water lock 22, as described above. Thus, the exhaust gas smoothly reaches the downstream exhaust pipe 23 and is exhausted to the outside of the watercraft body 2.

In the second modification shown in FIG. 5, the end portion 21A with the outlets 21D and the baffle 25 are integrated by welding and the like, for example. Thus, the bolts 26 (FIG. 3) for fastening the baffle 25 to the end portion 21A, and the bulge 21F to which the bolt 26 is installed are omitted. In a preferred embodiment, the outlets 21D are distributed equally or substantially equally in the circumferential direction S on the outer peripheral surface of the end portion 21A. The end portion 21A is fastened by, for example, bolts 35 to a portion of the upstream exhaust pipe 21 that is located upstream of the end portion 21A.

In the third modification shown in FIG. 6, the water lock 22 includes a partition 40 and a relay pipe 41. The partition 40 preferably has a circular or substantially circular plate shape which is similar to the rear baffle 22C of the water lock 22 and is located at a central or substantially central portion in the front-rear direction of the inner space 22B of the water lock 22. The partition 40 divides the inner space 22B into an upstream space 22L, which accommodates the end portion 21A of the upstream exhaust pipe 21, and a downstream space 22M which is located rearward relative to the upstream space 22L and accommodates the upstream end portion 23A of the downstream exhaust pipe 23. A drain hole 40A is located at a lower end of the partition 40 to drain cooling water collected in a lower portion of the upstream space 22L to the downstream space 22M.

The relay pipe 41 extends in the front-rear direction, is fixed to the partition 40, and penetrates the partition 40 in the front-rear direction. In a preferred embodiment, the relay pipe 41 includes two or more relay pipes 41, for example, and the two or more relay pipes 41 are aligned in the up-down direction, as shown in FIG. 6. The upstream space 22L and the downstream space 22M communicate with each other via an interior of the relay pipes 41. The exhaust gas which flows into the inner space 22B of the water lock 22 by being diffused radially outward in the cross direction Y2 from the outlets 21D flows rearward along the inner wall 22J of the water lock 22 in the upstream space 22L (refer to the broken line arrow Y3). The exhaust gas flows into the downstream space 22M via the interior of the relay pipes 41 and is exhausted to the outside of the watercraft body 2 via the downstream exhaust pipe 23. In a preferred embodiment, a taper 41A, which is enlarged in a forward direction, is located at a front end of the relay pipe 41. The exhaust gas in the upstream space 22L enters into the relay pipe 41 smoothly via the taper 41A.

In a preferred embodiment of the present invention, instead of the baffle 25, the flow direction diverter may include a guide 45, for example, as shown by a broken line in FIG. 6. The guide 45 changes the flow direction of the exhaust gas in the end portion 21A to the cross direction Y2. The guide 45 includes an inclined surface 45A disposed in the end portion 21A. The inclined surface 45A is inclined with respect to the pipe axis A and extends outward in a rearward direction and radial direction R, and includes a tapered surface or a planar surface. The flow direction of the exhaust gas flowing straight along the pipe axis A in the end portion 21A changes to the cross direction Y2 due to the inclined surface 45A, such that the exhaust gas passes through the outlets 21D of the end portion 21A.

In a preferred embodiment of the present invention, instead of the bolts 26, the fastener may include a nut, for example, to fasten the baffle 25 to the end portion 21A. The nut is installed, for example, on a screw shaft protruding rearward from the end portion 21A and penetrating the baffle 25. The baffle 25 is thus fastened to the end portion 21A by the nut.

It is to be understood that features of two or more of the various preferred embodiments described above may be combined.

The present application claims priority to Japanese Patent Application No. 2016-150144 filed on Jul. 29, 2016 in the Japan Patent Office, and the entire disclosure of which is incorporated herein by reference in its entirety.

While preferred embodiments of the present invention have been described above, it is to be understood that variations and modifications will be apparent to those skilled in the art without departing from the scope and spirit of the present invention. The scope of the present invention, thus, is to be determined solely by the following claims.

What is claimed is:

1. A watercraft comprising:

a watercraft body;

an engine in the watercraft body;

an upstream exhaust pipe that includes an end portion with an outlet, and that guides exhaust gas from the engine to the end portion;

a water lock that includes an inner space which houses the end portion and into which the exhaust gas flows from the outlet;

a downstream exhaust pipe that is connected to the water lock, and that exhausts the exhaust gas from the inner space to an outside of the watercraft body;

a flow direction diverter including a baffle that blocks the exhaust gas which reaches the end portion to change a flow direction of the exhaust gas at the outlet to a cross direction which intersects a pipe axis of the end portion;

a fastener that fastens the baffle to the end portion and is installed at a position spaced apart from the outlet in the end portion; and a bulge provided on an outer peripheral surface of the end portion, and the fastener fastens the baffle to the end portion by being installed to the bulge.

2. The watercraft according to claim 1, wherein the outlet opens in a direction that is perpendicular or substantially perpendicular to the pipe axis; and the flow direction of the exhaust gas is changed by being emitted from the outlet.

3. The watercraft according to claim 2, wherein the outlet opens toward the inner wall of the water lock.

4. The watercraft according to claim 3, wherein the flow direction diverter blocks the exhaust gas at the end portion such that the exhaust gas is not emitted from the end portion in a direction along the pipe axis.

5. The watercraft according to claim 1, further comprising a flow passage around the upstream exhaust pipe, wherein engine cooling water flows in the flow passage.

6. The watercraft according to claim 5, wherein the flow passage guides the engine cooling water to the inner space of the water lock.

7. The watercraft according to claim 1, wherein the flow direction diverter guides at least a portion of exhaust gas toward a circular arc portion of the inner wall of the water lock.

8. The watercraft according to claim 7, wherein the circular arc portion curves from the direction perpendicular to the pipe axis toward a direction parallel to the pipe axis.

9. An exhaust system for a watercraft with an engine, the exhaust system comprising:

an upstream exhaust pipe that includes an end portion with an outlet, and that guides exhaust gas from the engine to the end portion;

a water lock that includes an inner space which houses the end portion and into which the exhaust gas flows from the outlet;

a downstream exhaust pipe that is connected to the water lock, and that exhausts the exhaust gas from the inner space to an outside of a watercraft body;

a flow direction diverter including a baffle that blocks the exhaust gas which reaches the end portion to change a flow direction of the exhaust gas at the outlet to a cross direction which intersects a pipe axis of the end portion; and a fastener that fastens the baffle to the end portion and is installed at a position spaced apart from the outlet in the end portion; and a bulge provided on an outer peripheral surface of the end portion, and the fastener fastens the baffle to the end portion by being installed to the bulge.

10. The exhaust system according to claim 9, wherein the outlet opens in a direction that is perpendicular or substantially perpendicular to the pipe axis; and the flow direction of the exhaust gas is changed by being emitted from the outlet.

11. The exhaust system according to claim 10, wherein the outlet opens toward the inner wall of the water lock.

12. The exhaust system according to claim 11, wherein the flow direction diverter blocks the exhaust gas at the end portion such that the exhaust gas is not emitted from the end portion in a direction along the pipe axis.

13. The exhaust system according to claim 9, further comprising a flow passage around the upstream exhaust pipe, wherein engine cooling water flows in the flow passage.

14. The exhaust system according to claim 13, wherein the flow passage guides the engine cooling water to the inner space of the water lock.

* * * * *